United States Patent [19]

Sumerix

[11] Patent Number: 4,984,306

[45] Date of Patent: Jan. 15, 1991

[54] CHEMICAL INJECTOR ASSEMBLY

[76] Inventor: Carl L. Sumerix, 904 N. College Rd., Mason, Mich. 48854

[21] Appl. No.: 339,398

[22] Filed: Apr. 17, 1989

[51] Int. Cl.[5] ..... E03D 9/02

[52] U.S. Cl. ..... 4/224; 137/218; 4/225

[58] Field of Search ..... 4/225, 224, 605, 628, 4/223, 227, 309; 137/218, 217; 239/310

[56] References Cited

U.S. PATENT DOCUMENTS

| | | | |
|---|---|---|---|
| 2,449,573 | 9/1948 | White | 137/218 |
| 3,001,210 | 9/1961 | Diehl | 4/225 |
| 3,155,107 | 11/1964 | Woodford | 137/218 |
| 3,303,800 | 2/1967 | Young | 137/218 |
| 3,933,179 | 1/1976 | Hechler | 239/310 X |
| 4,013,088 | 3/1977 | Gocke et al. | 137/218 |
| 4,139,032 | 2/1979 | Taylor et al. | 137/513.3 |
| 4,238,074 | 12/1980 | Coons | 239/310 X |
| 4,262,372 | 4/1981 | Ryder | 4/224 |
| 4,301,972 | 11/1981 | Rudelick | 137/597 |
| 4,319,369 | 3/1982 | Lippencott, Sr. | 4/225 |
| 4,432,105 | 2/1984 | Pitroda | 4/605 |
| 4,478,236 | 10/1984 | Neuzeret et al. | 137/218 |
| 4,508,068 | 4/1985 | Tuggle et al. | 222/384 |
| 4,760,612 | 8/1988 | Dufau | 4/225 |
| 4,841,578 | 6/1989 | Mercer | 4/224 |

FOREIGN PATENT DOCUMENTS

| | | | |
|---|---|---|---|
| 2414893 | 10/1975 | Fed. Rep. of Germany | 137/218 |
| 1487494 | 7/1967 | France | 4/225 |

*Primary Examiner*—Henry J. Recla
*Assistant Examiner*—Robert M. Fetsuga
*Attorney, Agent, or Firm*—Dykema Gossett

[57] ABSTRACT

The invention relates to an automatic chemical injection system for injecting metered amounts of chemical into flush water as the flush water enters a toilet. The injector assembly is easily mounted into the flush water supply line. The assembly has an injector housing which has a truncated cone-shaped bore therein through which the flush water passes. The truncated cone-shaped bore has a smaller diameter opening which increases to a larger diameter opening in the direction of water flow. A smaller bore intersects the cone-shape bore adjacent the smaller diameter opening so that a venturi effect occurs at the opening of the smaller bore. The smaller bore is interconnected to a chemical reservoir so that chemical is pulled into the flush water as the flush water passes the smaller bore. A check valve is located in the smaller bore to permit chemical to be metered into the flush water but not permit flush water to back up into the chemical reservoir and dilute the chemical reservoir.

3 Claims, 2 Drawing Sheets

CHEMICAL INJECTOR ASSEMBLY

The present invention relates to a chemical injector assembly for selectively injecting a predetermined amount of chemical deodorant into the flush water of a self-contained toilet system. Self-contained toilets are toilets that include a holding tank for temporarily storing sewage and are typically found in recreational vehicles such as for example, motor homes, sailboats or motorboats.

More particularly, the chemical injector assembly of the present invention includes a novel injector housing which is adapted for easy insertion into a pressurized flush water line. The housing has a generally cone shaped bore through which flush water passes before entering the toilet. This bore functions as a venturi to pull chemical from a chemical supply and automatically inject or entrain a measured amount of chemical deodorant into the flush water passing through the housing. The housing is also provided with a check valve in the injection line which selectively opens in response to the venturi action of the flush water passing through the housing permitting a measured amount of chemical deodorant to be entrained in the flush water stream while closing when the flush water ceases to flow through the housing to prevent back flow into the chemical supply tank.

Typically, self-contained toilets require a chemical to be added to the holding tank to control odor. The chemical is typically added by pouring it into the toilet and then flushing the toilet to flush the chemical into the holding tank. One problem with this method of adding chemical is that it is difficult to obtain the correct ratio of chemical to water. If insufficient chemical is added, odor can be a problem and if too much chemical is added it is not economical. A further disadvantage in manually adding chemical is that the dye-layden chemical is difficult to clean from the toilet and, in concentrated form, can permanently stain the surface of the toilet.

U.S. Pat. No. 4,262,372, issued to Ryder on April 21, 1981 discloses a method of automatically injecting a chemical into a self-contained toilet system. Briefly stated, the Ryder patent discloses a self-contained toilet system having a liquid powered pump for injecting a liquid additive solution into a mainstream of flowing liquid. The pump is a three-port connection, a T-joint, having a first inlet port adapted to be connected to a main source of pressurized liquid, a second inlet port and an outlet port, these ports all being in communication with one another. A closed tank, non-vented, holds a supply of liquid additive which is connected so that the tank is filled with the liquid flowing into the first port of the connection out of the second port. The mainstream of liquid, once the tank is full and pressurized, draws a quantity of liquid additive solution from the additive tank via the additive line and directs it into the mainstream of liquid flowing from the first inlet to the outlet.

The disinfection system of Ryder has several disadvantages. One of the main disadvantages is the requirement of a closed unvented tank or bottle for containing chemical additive and the requirement that this unvented tank be pressurized. If for any reason the container leaks, the pressurized water flowing into the tank will force the chemical out of the container into the recreational vehicle. Another disadvantage of the system is that the chemical in the chemical storage tank is repeatedly being diluted during use. High chemical concentrations are injected during initial flushing with very low diluted concentrations being injected as the toilet is used. A further disadvantage is that when the tank is drained, a new supply of chemical must be used, otherwise the diluted chemical will be insufficient to properly treat the sewage. Therefore, every time the tank is drained a new supply of chemical should be used regardless of the amount of chemical remaining in the chemical tank. A still further disadvantage with the Ryder system is that it is complicated and requires repiping of the standard recreational vehicle system.

SUMMARY OF THE INVENTION

The present invention provides simplicity in use not found in the devices of the known prior art in that it provides a measured amount of liquid chemical deodorant, drawn from a non-pressurized supply tank, for injection into a pressurized flush water stream without diversion of the flush water through the chemical deodorant supply tank. The system of the present invention ensures that a pre-set ratio of chemical deodorant to flush water is always maintained in accordance with the chemical deodorant manufacturer's specifications. The chemical deodorant is delivered to the toilet in a diluted state already automatically pre-mixed with the flush water in the proper flush water-chemical deodorant ratio eliminating noxious chemical odors and damage to toilet surfaces.

The chemical injection system of the present invention automatically injects chemical into a self-contained toilet assembly. The toilet assembly includes a toilet bowl interconnected to a waste water holding tank with the chemical mixing with the flush water to chemically treat waste as the waste is expelled from the toilet bowl to the holding tank. The injection system includes an injector housing mounted in the water inlet line. This housing has a longitudinal bore extending therethrough so that flush water flows through the bore to the bowl. This bore has an increasing diameter in the direction of the flow of the flush water. A chemical supply line is interconnected to the injector housing and intersects the longitudinal bore adjacent the smaller diameter of the longitudinal bore. This line is operable to release chemical to the longitudinal bore as flush water passes through the bore.

In one embodiment, the chemical line is connected to a nipple which is received within a countersunk bore in the injector housing. The inserted end of the nipple is countersunk for receipt of a pressure responsive valve which permits chemical to be injected into the longitudinal bore as flush water passes through said longitudinal bore but prevents fluid from returning into said chemical line. Further, a chemical reservoir is provided which is coupled to the chemical line which is in turn coupled to the nipple.

A further embodiment of the present invention discloses an injector insert which is inserted into the path of water travel between the source of water and the toilet bowl. This insert has a truncated cone-shaped bore which increases in diameter in the direction of flow of flush water. A second bore intersects the truncated bore at or near the small diameter of the truncated bore. Attached to this second bore is a fluid line which, as water passes the second bore, releases chemical to be entrained with the flush water. Mounted within a nipple which defines the second bore is a pressure responsive valve which permits chemical to flow into the cone-shaped bore when flush water passes, but prevents fluid from returning into the chemical reservoir. Preferably, the pressure responsive valve means is a duckbill valve.

Nowhere in the prior art is there shown a toilet chemical injector assembly such as Applicant's claimed structure wherein a simple, economical and easily installed chemical injector structure is provided which is flush water actuated so as to selectively and automatically deliver a metered amount of liquid chemical deodorant into a flush water stream so that a predetermined chemical deodorant-flush water ratio mixture is delivered to the toilet.

It is therefore an object of this invention to provide a flush water actuated chemical injector which automatically delivers a liquid chemical deodorant from a non-pressurized liquid chemical supply tank directly into a flush water stream at a pre-determined ratio of chemical deodorant to flush water.

Another object of this injection is to provide a chemical injector which automatically delivers a predetermined amount of chemical deodorant directly into a flush water stream passing through the chemical injector.

Yet another object of this invention is to provide a chemical injector which automatically delivers a predetermined amount of chemical deodorant to a flush water stream in direct response to the passage of a flush water stream through the chemical injector.

A still further object of this invention is to eliminate the introduction of concentrated undiluted liquid chemical deodorant directly into the toilet bowl and into the toilet waste products storage tanks therebelow with its resultant undesirable noxious chemical odors due to its concentrated state.

Other objects and advantages found in the construction of the invention will be apparent from a consideration of the following specification in connection with the appended claims and the accompanying drawings.

DETAILED DESCRIPTION OF THE INVENTION

Figure 1:
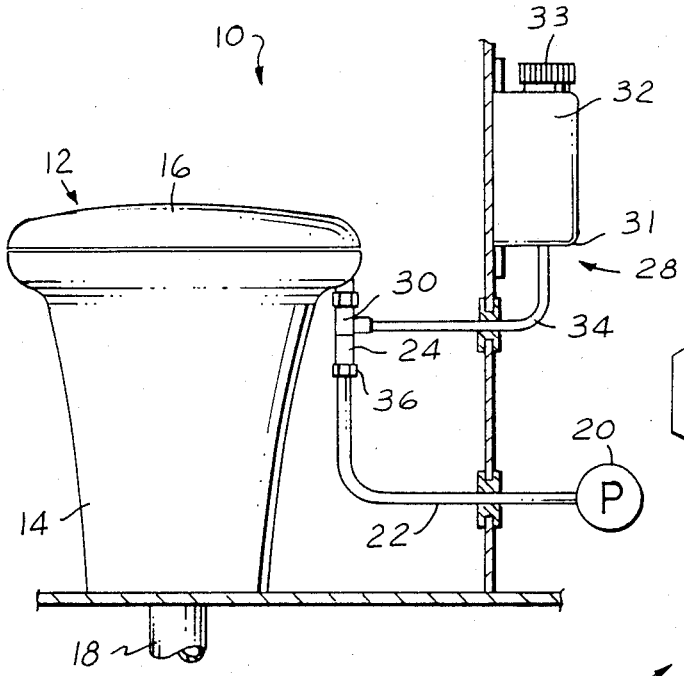
FIG. 1 is a side view of a self-contained toilet assembly commonly found in recreational vehicles employing the injector assembly of the present invention.

With reference to FIG. 1, a toilet unit commonly used in recreational vehicles is generally shown at 10. Unit 10 includes a toilet 12 having a bowl 14 and lid 16. A sewage pipe 18 extends from the bottom of bowl 14 into a holding tank. The holding tank is not shown. As is common in recreational vehicles, connecting pipe 18 does not have an elbow joint to maintain standing water in bowl 14. Therefore, other than the use of trap valves, there is no way to prevent odor from escaping the holding tank and entering the recreational vehicle. Therefore, a deodorant chemical must be added to the holding tank to control the odor of sewage. As previously discussed, this is typically done by pouring chemical into bowl 14 and flushing the toilet so that the chemical is expelled into the holding tank.

The flushing system of a standard recreational vehicle toilet employs a pump 20 or other pressurized water supply to provide pressurized water through a water line 22 to the toilet bowl 14. The pressurized water is controlled by a flush valve which is not shown, but which is found within the toilet 12. Additionally, a vacuum breaker 24 is provided to prevent fluid from being pulled in the opposite direction to ensure that the fresh water supply is not contaminated. Upon actuation of the flush valve, pressurized water is supplied to the toilet bowl 14 to flush sewage into the holding tank through pipe 18.

With the exception of the chemical injector assembly 28 which includes injector housing 30, vacuum breaker assembly 24, fluid reservoir 32 and chemical injection line 34, the toilet illustrated in FIG. 1 is conventional. The chemical injector assembly 28 of the present invention is easily attached to the toilet assembly to provide automatic injection of chemical into the flush water as the flush water is entering the toilet. The chemical is maintained in fluid reservoir 32 and when depleted, cap 33 can be removed and further chemical can be added as required. Fluid from reservoir 32 is drawn out by the injector housing 30. In this embodiment, the fluid travels from reservoir 32 through a chemical injection line 34 and into the flush water passing through line 22. It should be apparent that line 34 would not be necessary if a direct connection were made between injector housing 30 and reservoir 32.

Figure 2:
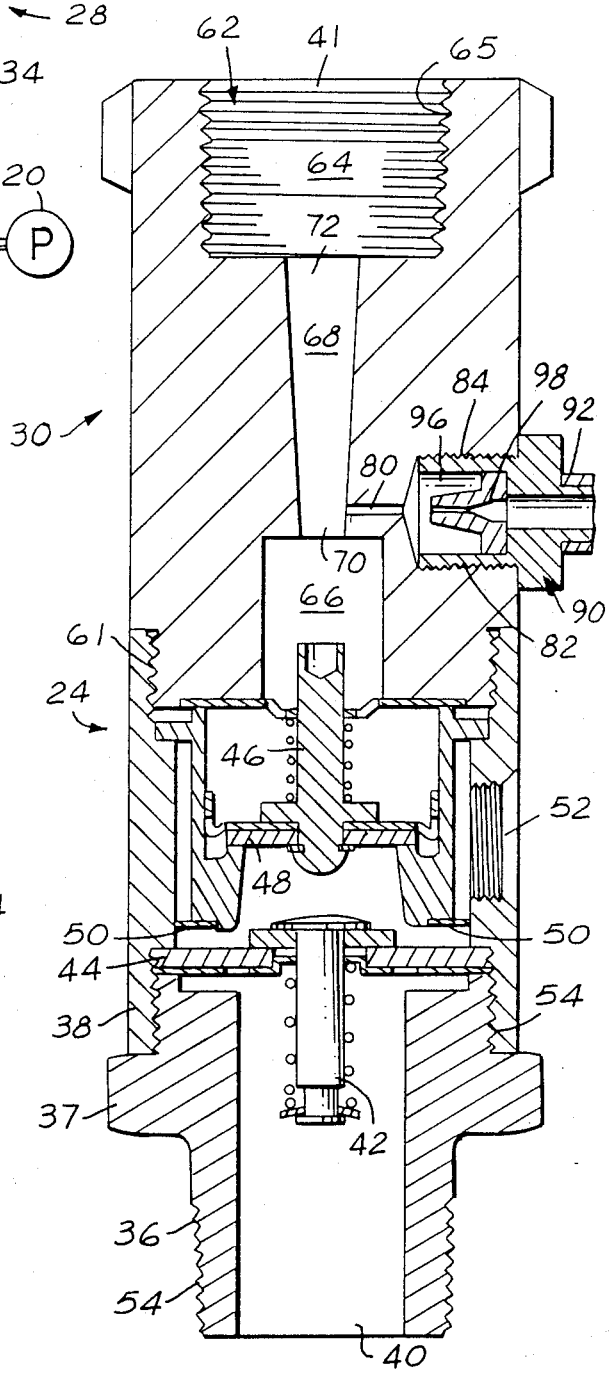
FIG. 2 is a cross-sectional view of an embodiment of the present invention wherein the chemical injector assembly of the present invention is interconnected to a vacuum breaker assembly for insertion into the water line of a recreational vehicle.

With reference to FIG. 2, a cut-away view of the injector housing 30 and vacuum breaker 24 are illustrated. Water line 22 is connected through a coupling 36 to a vacuum breaker assembly 24 which has a coupling 38 for receipt of coupling 36. Coupling 37 has externally threaded portions 54 at each end. Coupling 38 is adapted to thread onto threads 54 and the housing of vacuum breaker 24 is adapted to thread onto threads 54 at the opposite end of coupling 37. The housing of vacuum breaker 24 has internal threads 61 at its opposite end into which the injector housing 30 can be threaded. The opposite end of injector housing 30 is adapted for threading onto a pipe or nipple extending from toilet 12. Threads 65 are provided so that it can be attached to toilet 12. Once attached, water from water line 22 can flow into inlet 40 and exit from outlet 41 for entry into the toilet 12 upon actuation of the flush handle of toilet 12.

Vacuum breaker 24 includes first and second spring biased check valves 42 and 46. These valves each have seals 44 and 48 respectively to prevent water from seeping through the system and into the toilet when the flush valve is not actuated. The springs on the check valves 42 and 46 are sized so that upon actuation of the flush valve, the pressure of the water in line 22 unseats the check valves permitting water to pass into the bore 62 of injector housing 30.

The vacuum breaker is used to ensure that chemical from the toilet system is not pulled back into the fresh water supply of the recreational vehicle or auxiliary fresh water supplies. If a vacuum is pulled at inlet 40, the check valves 42 and 46 close. However, if this vacuum continues to increase, there is a possiblity that the check valves will leak. To prevent the seals from leaking and pulling chemical into the fresh water, an air inlet 52 is provided in the housing of vacuum breaker 24. If check valve 42 leaks, air is pulled in inlet 52 so that no vacuum acts upon check valve 46. In this way, chemical cannot get past check valve 46. The air which is pulled in inlet 52 is permitted past seals 50 during this situation.

The injector housing 30 of the present invention has a bore 62 extending through it so that flush water can pass into the toilet through injector housing 30. The bore has opposite countersunk portions 64 and 66 which are interconnected by a truncated cone-shaped bore 68. Bore 68 has a smaller diameter opening 70 which increases to a larger diameter opening 72 in the direction of flush water flow. This bore 68 creates a venturi effect at smaller bore 80 to pull chemical from reservoir 32. Smaller bore 80 is formed in the side wall of injector housing 30 and intersects the cone-shaped bore 68 near the smaller diameter opening 70. Bore 80 has a countersunk portion 82. The inner walls of portion 82 are threaded at 84 for receipt of a nipple connector 90. An extension 92 extends from nipple 90 for receipt of chemical injector line 34. The end opposite extension 92 is countersunk for receipt of a duckbill valve 98.

Figure 3:
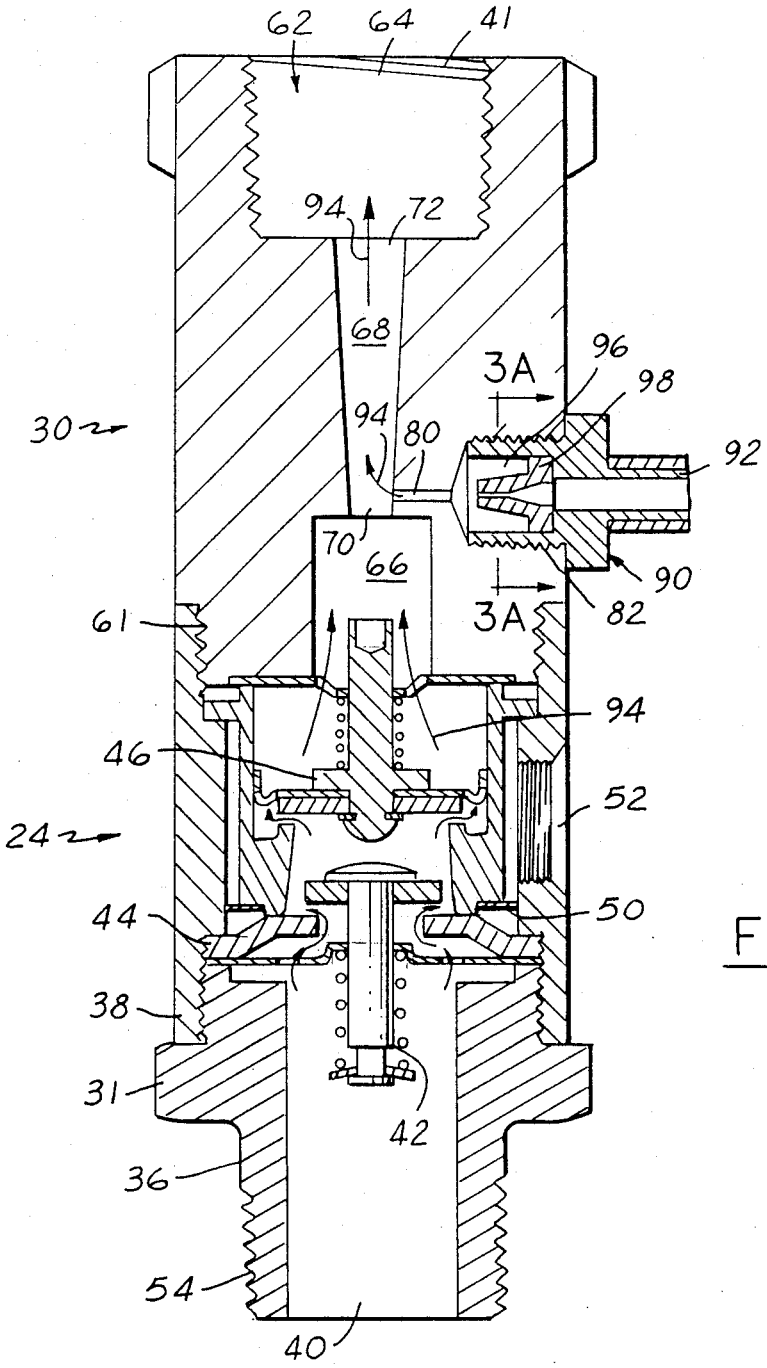
FIG. 3 is a cross-sectional view similar to FIG. 2 showing the flow path of the flush water as it passes through the vacuum breaker and injector assembly of the present invention.

In operation, water passing through bore 62 creates a venturi effect at the intersection of bore 80 with bore 68 to pull chemical from reservoir 32 through line 34 into the water stream. With reference to FIG. 3, the flow path of water and chemical is illustrated by arrows 94.

Figure 3A:
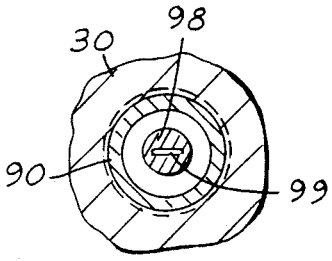
FIG. 3*a* is a cross-sectional view taken along line 3*a* of FIG. 3 illustrating the duckbill valve of the present invention.

The duckbill valve 98 is designed to open at the pressure created by the venturi effect. With reference to FIG. 3*a*, the duckbill valve 98 is shown with its aperture 99 open permitting the flow of chemical into the flush water. When the flow of flush water has stopped, the duckbill valve 98 closes, preventing any back flow of water into the chemical reservoir 32 thereby preventing any dilution of the chemical. Other types of check valves can be used in place of duckbill valve 98. However, Applicant has found that the duckbill valve is preferred and that other types of check valves are unsatisfactory.

It should be understood, that the size of bores 68 and 80, and the intersection of bore 80 with bore 68 will basically determine the ratio of chemical to flush water in the system. In the preferred embodiment, the smaller diameter 70 of bore 68 is 0.140 inches with the larger diameter 72 being 0.234 inches. The length of bore 68 is 0.875 inches. The diameter of bore 80 is 0.0312 inches and it is 0.064 inches from the smaller diameter bore opening 70. With these preferred dimensions, the system is able to provide a chemical to flush water ratio recommended by the chemical manufacturer every time the toilet 12 is flushed.

An important feature of the present invention is that the reservoir 32 can be placed at remote locations without adversely affecting the proper metering of chemical into the flush water. However, for best results, the reservoir output opening 31 should be on the same horizontal plane as the smaller bore 80 or elevated above this plane. Applicant has tested this system with the reservoir located approximately 20 feet from the injector housing 30 and found that there is no adverse affect to proper chemical metering. As should be appreciated, the ability to remotely locate the reservoir permits the reservoir to be filled at convenient locations, such as in the engine compartment or at a location outside the living area of the recreational vehicle. In this way, the possibility of inadvertently spilling chemical in the recreational vehicle is eliminated.

Figure 4:
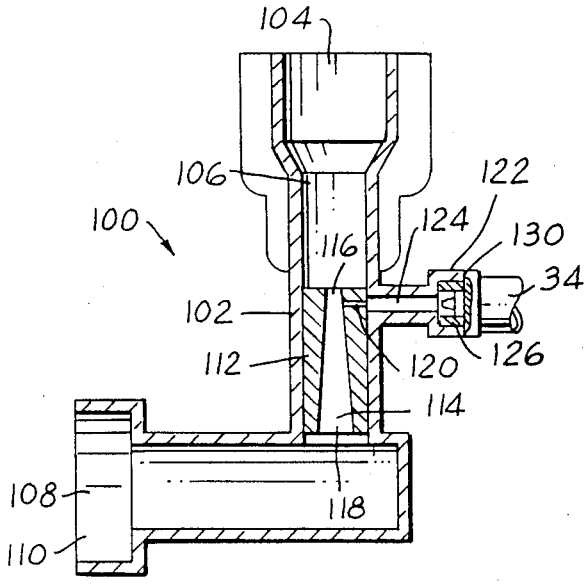
FIG. 4 is a cross-sectional view of a further embodiment of the present invention.

With reference now to FIG. 4, a further embodiment of the present invention is shown. FIG. 4 illustrates a common vacuum breaker used in toilets of recreational vehicles which has been modified to include the chemical injector assembly 28 of the present invention. FIG. 4 illustrates only a cut-away view of the vacuum breaker with the remainder of the vacuum breaker not being shown. The vacuum breaker has two water passages wherein water enters one tube in which a vacuum breaker means is positioned and then flows into a chamber 104 connecting the first tube with a second tube which is shown in FIG. 4 and indicated by the numeral 102. From chamber 104 water flows into bore 106 and exits from bore 108. The vacuum breaker 100 of FIG. 4 can be mounted to the toilet 12 at 110.

An injector insert 112 is mounted into the water passage 106 of vacuum breaker assembly 100. This insert has a truncated cone-shaped bore 114 which has a smaller diameter opening 116 which increases to larger diameter opening 118. The increase in diameter is in the direction of water flow so that a venturi effect can be obtained at smaller bore 120 which intersects bore 114 adjacent smaller diameter 116. The smaller bore 120 is in fluid communication with the bore 124 of nipple 122. Bore 124 is countersunk at 126 for receipt of a duckbill valve 130 which acts in the same way as duckbill valve 98 of the first embodiment. Chemical injection line 34 is mounted to nipple 122 to supply chemical from chemical reservoir 32. Again, line 34 would not be necessary if reservoir 32 were mounted directly to breaker assembly 100.

The operation of the second embodiment is basically the same as that of FIG. 2 with water flowing through passage 106 upon actuation of the flush handle of toilet 12. As the water flows through insert 112 venturi effect occurs at bore 120 pulling chemical from reservoir 32 and entraining it into the flush water stream. This chemical is pulled through duckbill valve 130 which opens slightly for this purpose. The chemical is metered into the flush water as a function of bore size 120, its placement with respect to opening 116 and the bore size of bore A preferred embodiment of the present invention has been disclosed; however, certain modifications will be obvious to one of ordinary skill in the art. Therefore, reference should be had to the appended claims to determine the proper scope of this invention.

What is claimed is:

1. In a self-contained toilet assembly mounted in a vehicle having a self-contained water supply, said assembly including a toilet bowl having a flush handle and interconnected to a waste water holding tank on said vehicle, and including a chemical injection system for automatically injecting a chemical to mix with flush water sent to said toilet bowl from a water inlet line connected to said vehicle water supply, said flush water being sent to said toilet bowl upon actuation of said flush handle, said chemical chemically treating said flush water as said flush water is dispensed into said toilet bowl, an improved chemical injection system comprising:

an injector housing mounted in said water inlet line, said housing having a truncated cone-shaped bore with a smaller diameter opening increasing to a larger diameter opening in the direction of flush water flow; and a chemical input line interconnected to said injection housing in fluid communication with said longitudinal bore, said input line communicating with said bore adjacent the smaller diameter of said longitudinal bore, said input line having an input check valve therein operable to release chemical to said flush water as said flush water passes through said bore, said input check valve being a duckbill valve; and a vacuum breaker valve assembly positioned in said water inlet line upstream of said injector housing, said vacuum breaker valve comprising a pair of spring-biased water check valves, said water check valves being spaced apart along said water inlet line such that one water check valve is further upstream than the other, an air inlet being positioned intermediate said water check valves, a seal normally blocking communication between said air inlet and said water inlet line, such that said springs normally bias said water check valves to a closed position when said flush water is not being sent to said toilet bowl, which prevents flow of said chemical upstream into said water inlet line, and then into said vehicle water supply, said air inlet communicating air past said seal on said air inlet should an excessive vacuum be pulled on said water inlet line upstream of said upstream water check valve, thus preventing leakage of said chemical around said water check valves to contaminate said vehicle water supply.

2. The invention of claim 1, wherein said vacuum breaker valve assembly is received within a vacuum breaker housing, said injector housing having a threaded portion at an upstream end, said vacuum breaker housing having a threaded portion at a downstream end, said vacuum breaker housing being threadably attached to said injector housing.

3. In a self-contained toilet assembly mounted in a device having a self-contained water supply, said assembly including a toilet bowl having a flush handle and interconnected to a waste water holding tank on said device, and including a chemical injection system for automatically injecting a chemical to mix with flush water sent to said toilet bowl from a water inlet line connected to said water supply, said flush water being sent to said toilet bowl upon actuation of said flush handle, said chemical chemically treating said flush water as said flush water is dispensed into said toilet bowl, an improved chemical injection system comprising:

an injector housing mounted in said water inlet line, said housing having a truncated cone-shaped bore with a smaller diameter opening increasing to a larger diameter opening in the direction of flush water flow; and a chemical input line interconnected to said injection housing in fluid communication with said longitudinal bore, said input line communicating with said bore adjacent the smaller diameter of said longitudinal bore, said input line having an input check valve therein operable to release chemical to said flush water as said flush water passes through said bore; and a vacuum breaker valve assembly positioned in said water inlet line upstream of said injector housing and including means for preventing flow of said chemical upstream into said water inlet line, and then into said water supply and communicating air into said water inlet line should an excessive vacuum be pulled on said water inlet line upstream of said vacuum breaker valve assembly, thus preventing leakage of said chemical around said vacuum breaker valve assembly to contaminate said water supply.

* * * * *